US006536065B2

(12) United States Patent
Forrest

(10) Patent No.: US 6,536,065 B2
(45) Date of Patent: Mar. 25, 2003

(54) MULTI-BRUSH ULTRASONIC NAIL CLEANER

(76) Inventor: Andrea Forrest, Rockledge Farm, Highgate Rd., St. Albans, VT (US) 06478

( * ) Notice: Subject to any disclaimer, the term of this patent is extended or adjusted under 35 U.S.C. 154(b) by 210 days.

(21) Appl. No.: 09/792,247

(22) Filed: Feb. 26, 2001

(65) Prior Publication Data

US 2002/0116774 A1 Aug. 29, 2002

(51) Int. Cl.[7] ..... A46B 13/00; A47L 11/00

(52) U.S. Cl. ..... 15/22.1; 15/97.1; 15/21.1; 15/167.1; 15/167.3; 15/22.2; 15/105; 15/4; 132/73.5; 132/73.6; 132/75.8; 132/75.3; 132/76.4; 132/73

(58) Field of Search ..... 15/22.1, 97.1, 15/21.1, 167.1, 167.3, 222, 105, 4; 132/73, 73.5, 73.6, 74.5, 75.3, 75.8, 76.5, 76.4; 601/2

(56) References Cited

U.S. PATENT DOCUMENTS

| | | | | | |
|---|---|---|---|---|---|
| 3,512,202 | A | * | 5/1970 | Taylor | 15/23 |
| 5,890,249 | A | | 4/1999 | Hoffman | |
| 5,947,131 | A | | 9/1999 | Kim | |
| 6,035,858 | A | | 3/2000 | Park | |
| 6,334,232 | B1 | * | 1/2002 | Sato | 15/167.2 |

* cited by examiner

*Primary Examiner*—Robert J. Warden, Sr.
*Assistant Examiner*—Shay L. Balsis
(74) *Attorney, Agent, or Firm*—Stanley J. Yavner

(57) ABSTRACT

This invention provides an ultrasonically driven nail cleaner, where the ultrasonic frequency both loosens hand and nail soil, as well as providing motion to at least a pair of brushes for removing the soil from the user's hands and nails. The moving force for the brushes and the ultrasonic loosening action are enabled by linkages providing straight line bilateral motion for both of the brushes. A rechargeable battery and a battery charger are provided for multiple uses for the structure provided, without the necessity of an AC outlet proximate the user.

5 Claims, 6 Drawing Sheets

FIG. 6
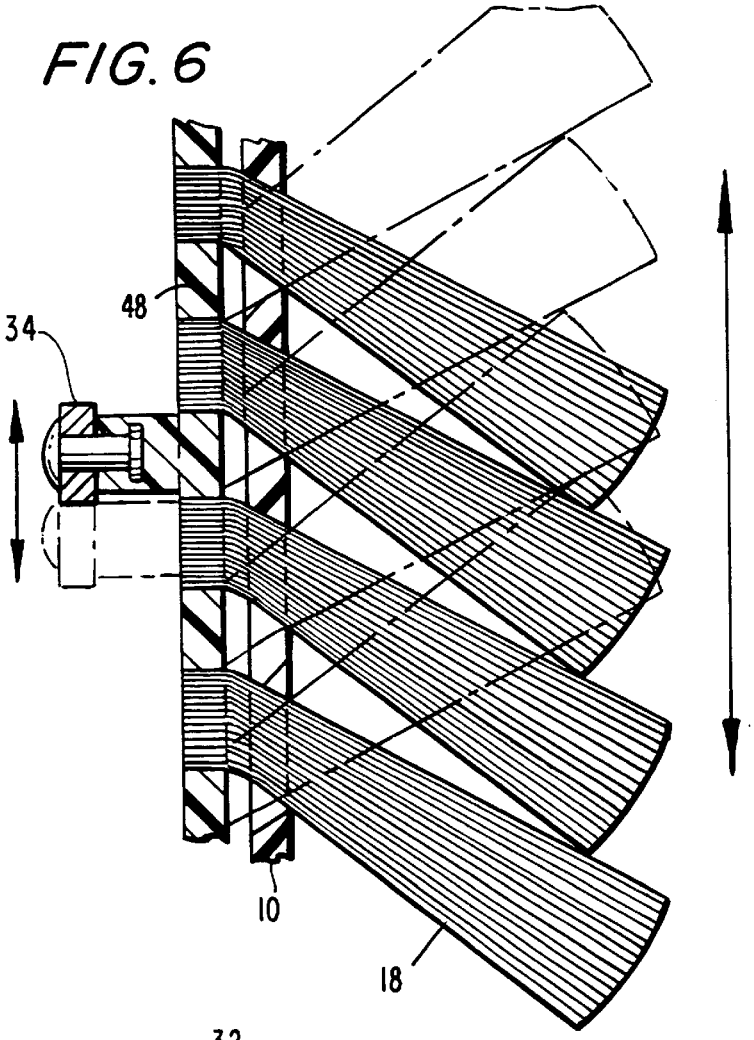
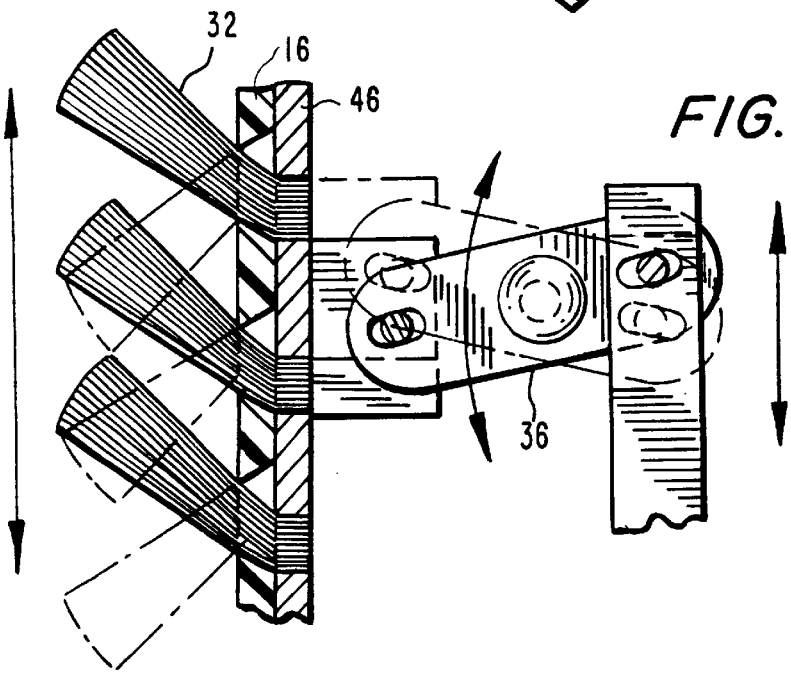
FIG. 7

FIG. 8
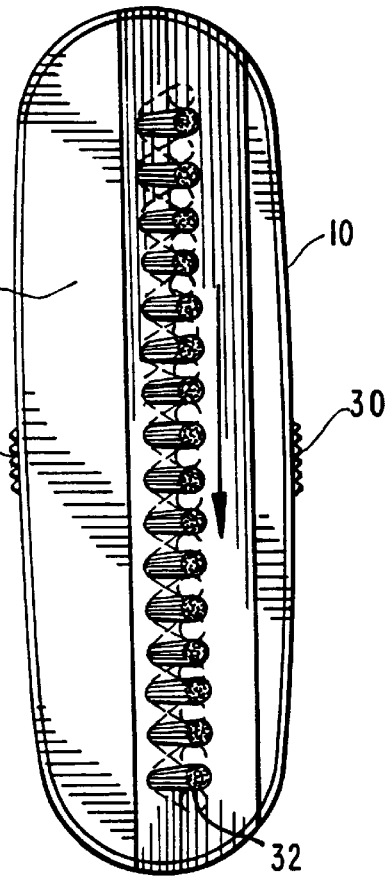
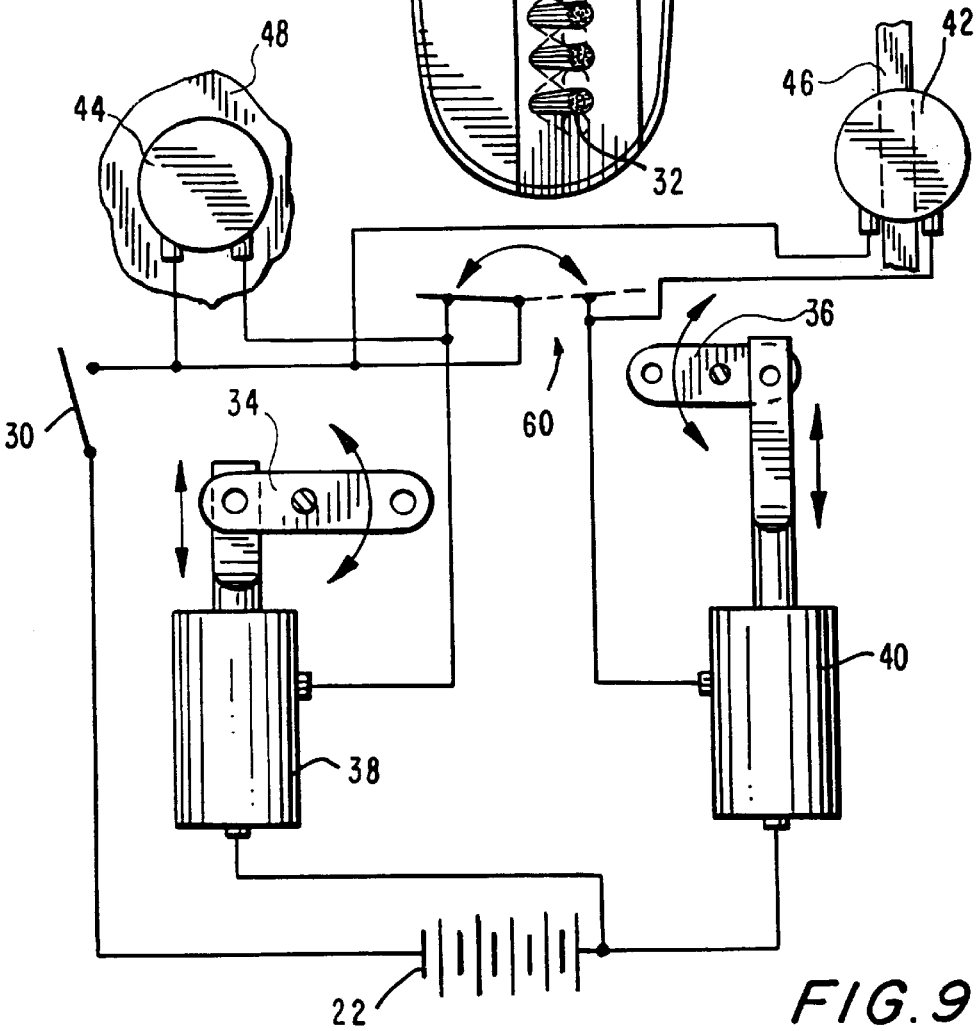
FIG. 9

MULTI-BRUSH ULTRASONIC NAIL CLEANER

FIELD OF THE INVENTION

This invention relates primarily to personal cleaning apparatus and devices and more particularly to apparatus and devices for fingernail and hand cleaning, specifically to aid those home and commercial gardeners who frequently have their fingernails and hands covered with moist soil from garden beds.

BACKGROUND OF THE INVENTION

Commercial gardening, in the form of retail nurseries and those who provide gardening services at private homes has become a large industry in the United States and other parts of the world today. As the global economy has developed and increased, more and more private home owners are relying upon professional gardening services to both supply them with shrubs and other provisions required for home gardening and to care for home gardens and lawns. Furthermore, notwithstanding the professional services used by private home owners per the foregoing, private home owners at least reserve or develop a small portion of their gardens for recreation and care. In either case, the professional nursery personnel and private home owners often find themselves having hands and fingernails caked with moist soil, which, particularly if ignored, becomes increasingly difficult to remove. Of course, standard soap and water provides a partially suitable solution to this problem, but nevertheless, the caking of moist soil on hands and fingernails is never quite totally removed by this process.

In order to increase the amount of such soil removal by such persons, there is always the small, hand-operated nail brush that might be found in many commercial and home rest rooms; but again, the amount of moist soil on hands and fingernails is never totally removed, even if soap and water is supplemented by the small, hand-operated nail brushes available.

Also, ultrasonically powered mechanisms for purposes quite different than the present invention have been developed. For instance, in Park U.S. Pat. No. 6,035,858, the inventor provided a power package to present an ultrasonic wave energy for both removing artifical fingernails and for cleaning under the nails. The ultrasonic energy produced waves in a liquid solution, but Park does not provide brushes for enhancing the treatment. Kim U.S. Pat. No. 5,947,131 shows an apparatus for imparting ultrasonic vibrations to a liquid solution to break down an adhesive in order to remove artificial nails; but Kim also does not have a brush package for his apparatus. Hoffman U.S. Pat. No. 5,890,249 does offer a brush package, moved by ultrasonic energy; but household cleaning is his target, rather than caked soil on hands and under fingernails. Accordingly, the brush configuration and mechanism of Hoffman is not suitable for the objectives of the present invention.

OBJECTS AND SUMMARY OF THE INVENTION

Accordingly, a primary object of the present invention is to provide an ultrasonic energy linking mechanism to brush bristles for presenting a structure which removes substantially all of the moist soil from the hands and fingernails of the user. A further and more particular object of the present invention is to provide an ultrasonic energy linking mechanism to bristles on a base of a brush, both for dislodging caked moist soil from the hands and fingernails of the user, and for brushing away such soil after such soil is loosened by the ultrasonic energy.

These, and other objects of the present invention are provided in a structure which features a solid brush base of non-conductive material defining a cavity therein, a rechargeable battery within the cavity of the base, and with a single row of brush bristle clusters protruding from the brush base, on one surface thereof, and multiple rows of brush bristle clusters protruding from another surface of the brush base. A pair of electronic driving modules are within the brush base for converting energy supplied by the battery to an ultrasonic frequency DC current. The electronic driving modules are connected to a pair of piezoelectric transducers by connecting wires. As the piezoelectric transducer crystal resonates, expands and contracts volumetrically in tune with the frequency supplied by the electronic driving module, the electronic energy is thereby converted into sound wave energy. In this way, the bristle clusters conduct such sound wave energy to the caked moist soil on the user's hands or fingernails, depending upon with which bristles, the single row or the multiple row bristles, contact is made with the user's hands or fingernails. Alternatively, after dislodging by the above action of the caked moist soil, the sound waves continue to drive the brush bristles in a longitudinal back and forth motion to remove the dislodged soil.

In the preferred embodiment of the present invention, the two sets of bristles (single row and multiple row) are operated by use of a two-way switch. The operated sets of bristles conduct the ultrasonic energy to loosen the caked moist soil, and then remove the loosened soil.

BRIEF DESCRIPTION OF THE DRAWINGS

Other objects, features and advantages of the present invention will become apparent by reference to the following detailed description of the preferred, but nonetheless illustrative, embodiment of the present invention, with reference to the accompanying drawings, wherein:

FIG. 6 is a partial side sectional view taken along the line 6—6 of FIG. 4, and showing particularly the motion of part of the row of bristle clusters of the multiple row set on one surface of the brush base;

FIG. 7 is a partial section view taken along the line 7—7 of FIG. 2, and showing particularly the motion of the row of bristle clusters of the single row set on another surface of the brush base;

FIG. 8 illustrates, in a back view, the angular orientation of the single row set of bristle clusters; and FIG. 9 shows, in simplified form, the circuit connecting the battery, the electronic driving modules and the transducers of the present invention, as well as the switches therefor.

DETAILED DESCRIPTION OF THE PREFERRED EMBODIMENT

Figure 1:
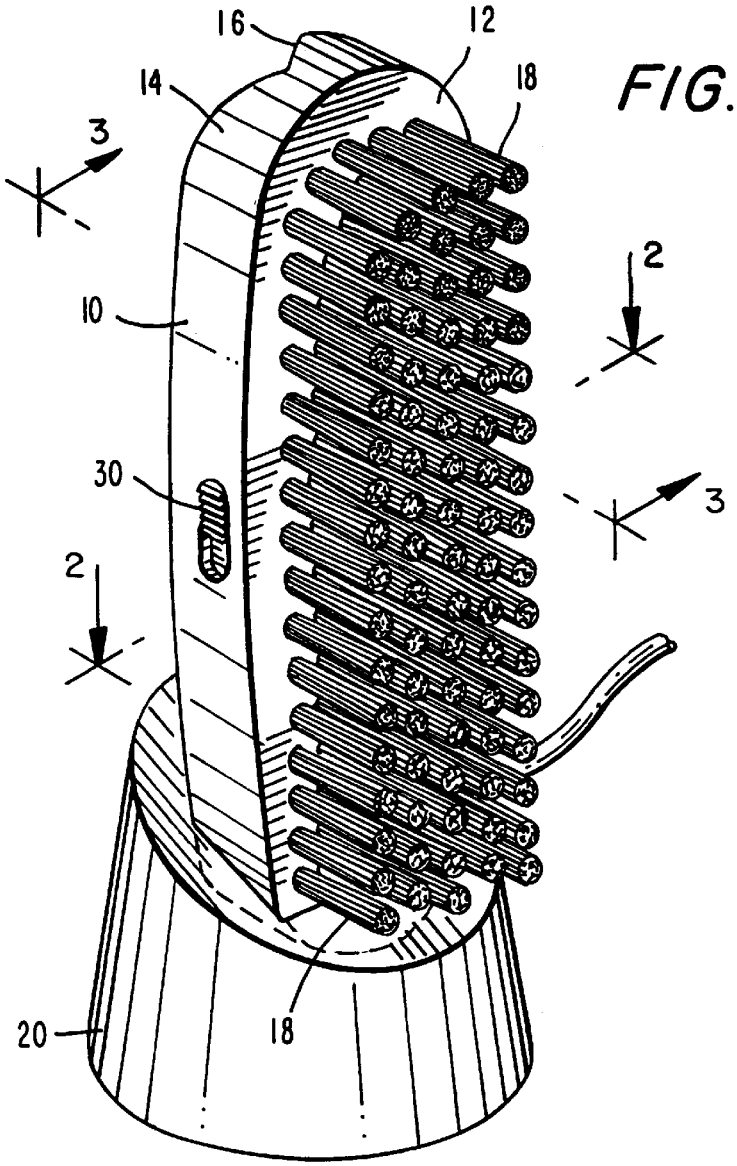
FIG. 1 is an isometric view of the front, left side and top of the preferred embodiment of the present invention, showing particularly the multiple rows of bristle clusters on the front surface of the brush base.
Figure 4:
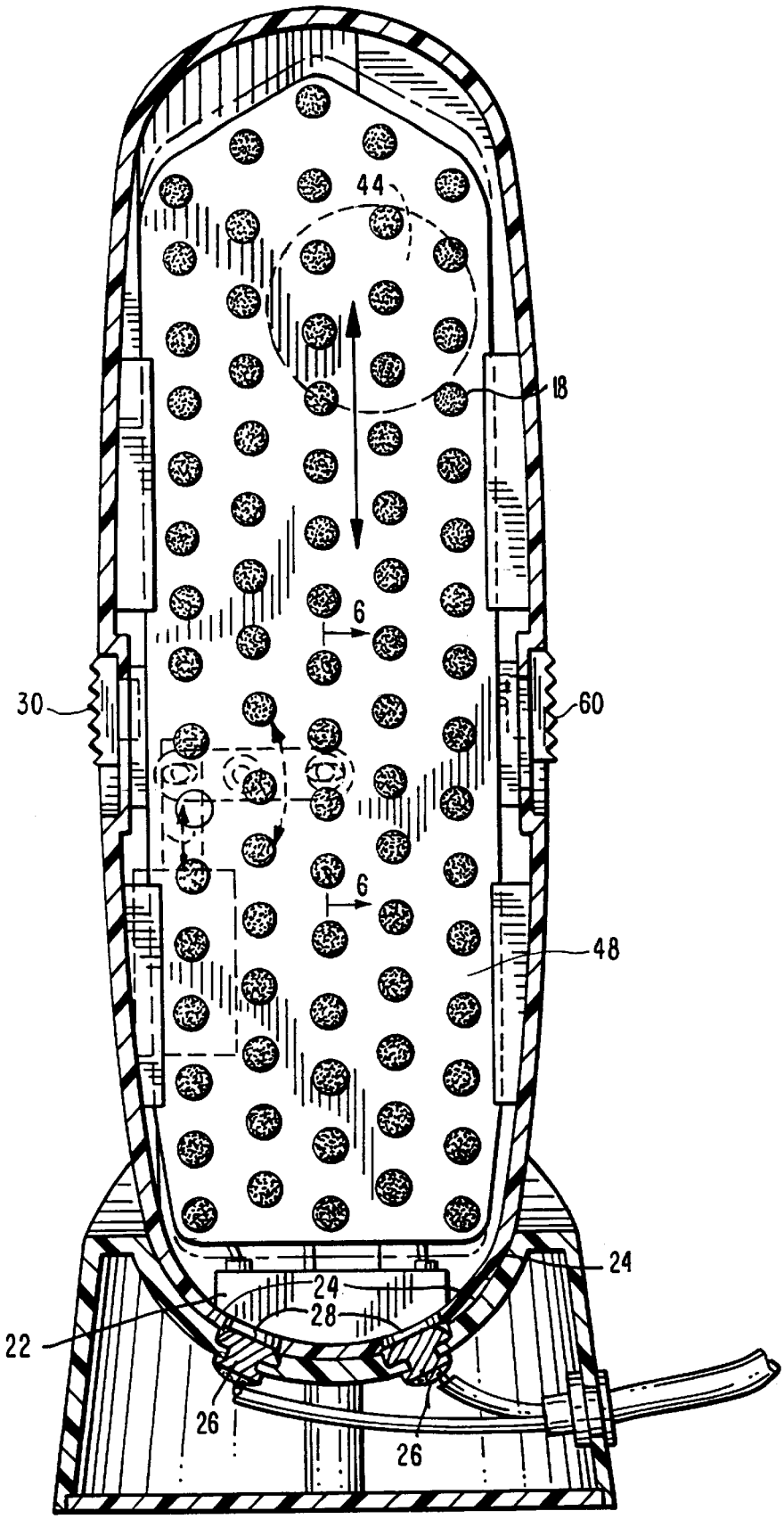
FIG. 4 is a front sectional view taken along the line 4—4 of FIG. 3 and showing particularly the multiple rows of bristle clusters on the front surface of the brush base.

Referring to the drawings, FIG. 1 shows brush base 10, defining various surfaces 12, 14, 16, etc. Brush base 10 is formed of a non-conductive material, and protruding from surface 12 are multiple rows of brush bristle clusters 18. Brush base 10 is formed so that it nestles within a battery recharging unit 20 for recharging battery 22 (FIG. 4). For that purpose, battery recharging unit 20 defines concavity 24 through which protrudes battery contacts 26, for matching terminals 28 of battery 22 (all shown in FIG. 4).

Figure 2:
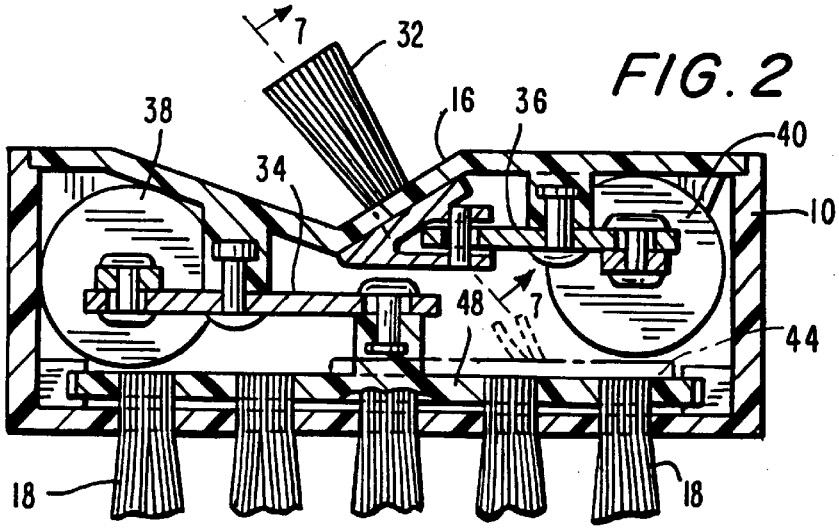
FIG. 2 is a top sectional view, taken along the line 2—2 of FIG. 1 and showing particularly the location of the single row of bristle clusters angularly arranged on another surface of the brush base, as well as the primary linkage between the electronic driving module and the piezoelectric transducer proximate the multiple brushes on surfaces of the brush base.

For the operation of the present invention, an on/off switch 30 is provided through an opening defined by surface 14 of brush base 10. Brush base 10 further defines surface 16, from which protrudes a single row of brush bristle clusters 32, which may be seen in FIG. 2 as arranged angularly with respect to the multiple rows of brush bristle clusters 18. Various linkages 34, 36 are provided to connect electronic driving modules 38, 40 to piezoelectric transducers 42, 44 and link 46 for the single row of bristle clusters 32 (FIG. 5), and link 48 for the multiple rows of bristle clusters 18. Piezoelectric transducers 42, 44 are also connected electrically by wires 50, 52, and others, from the electronic driving modules 38, 40. Electronic driving modules 38, 40 provide the function of converting the energy supplied by battery 22 to ultrasonic frequency DC current. Thereby, the electronic energy is converted into sound wave energy as the piezoelectric transducers 42, 44 resonate, expand and contract volumetrically in tune with the frequency supplied by the electronic driving modules 38, 40.

Figure 3:
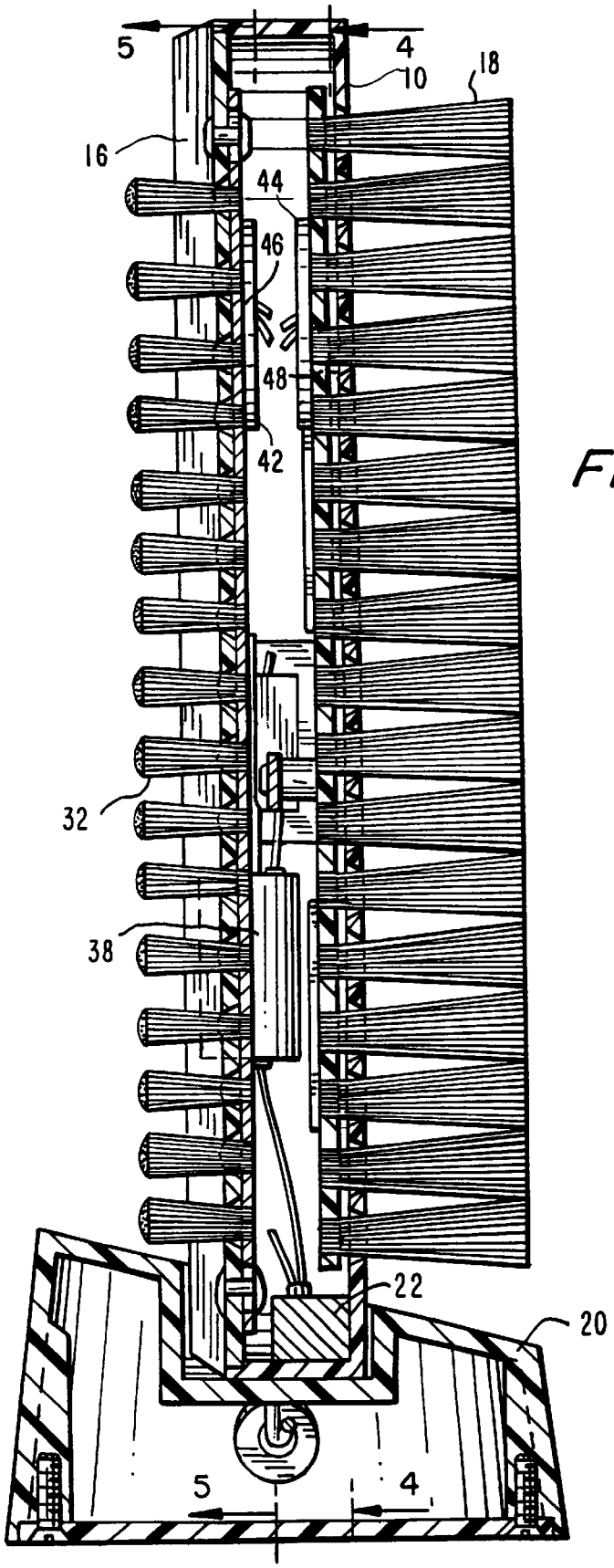
FIG. 3 is a left side sectional view, taken along the line 3—3 of FIG. 1, and showing particularly the two sets of bristle clusters protruding from the brush base.

Overall, FIG. 3 shows the two sets of bristle clusters 18, 32, as mounted on links 48 and 46. It also is seen from FIG. 3, the structural relationship between battery 22, its recharging unit 20 (when the present invention is not in use), electronic driving module 38, piezoelectric transducers 42, 44, and the links 46, 48 for bristle clusters 32, 18.

Figure 5:
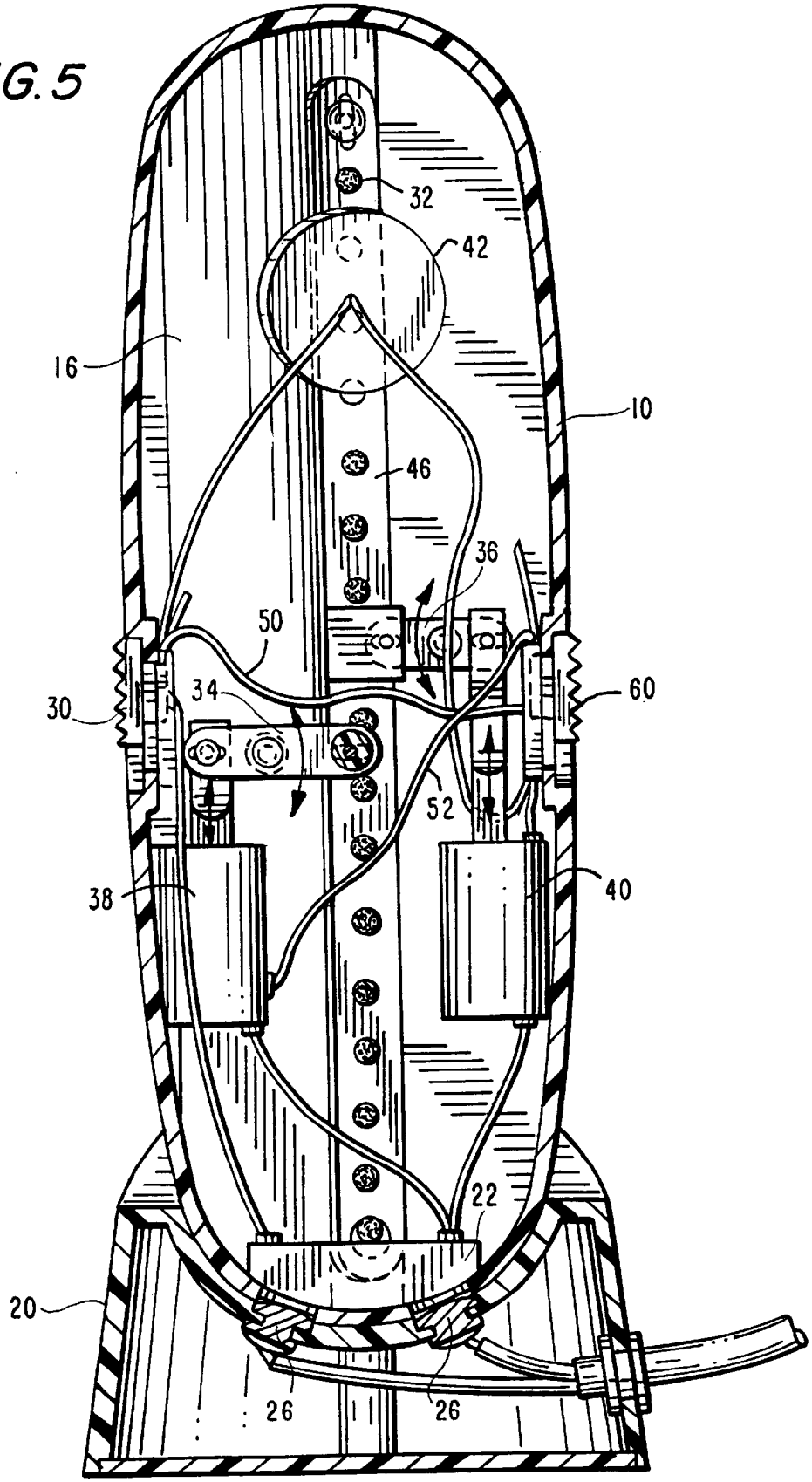
FIG. 5 is a front sectional view taken along the line 5—5 of FIG. 3 and showing particularly the connections between the electronic driving module of the single row of bristle clusters to one surface of the brush base.

FIGS. 4 and 5 illustrate particularly the relationships of the various elements of the present invention with the multiple rows of bristle clusters 18 and single row of bristle cluster 32.

As shown in the drawings, the operation of the multiple rows of bristle clusters 18 is linked to and operated by electronic driving module 38, piezoelectric transducer 44, link 48 and linkage 34; whereas the single row of bristle clusters 32 is linked to and operated by electronic driving module 40, piezoelectric transducer 42, link 46 and linkage 36.

FIG. 6 shows the motion imparted, by the ultrasonic electronics package as previously described, to the multiple row set of bristle clusters 18, with FIG. 7 showing the motion imparted to the single row set of bristle clusters 32.

FIG. 8 shows in even more detail the structure of the single row set of bristle clusters 32, as enabled by its elements as set forth above; whereas, some of the elements for the multiple row set of bristle clusters 18 are shown most clearly in FIG. 6.

Lastly, by way of describing the present invention, the electrical circuit thereof is illustrated in FIG. 9, showing the battery, the electronic driving modules 38, 40, linkages 34, 36, links 48, 46 and transducers 44, 42.

In order to provide a more complete description, a series of use steps is now presented. The user first picks up the brush base 10 with protruding bristle clusters from the recharging unit 20, by removing brush base 10 from its recharging unit 20. The user then closes switch 30 to activate the unit. If the user wishes to impart energy and motion to the multiple rows of bristles, switch 60 is moved upwardly in the orientation of FIGS. 4 and 5. The multiple rows of bristle clusters are moved over one hand and then the other, the bristles conducting the sound wave energy in order to loosen the moist soil that has accummulated on his or her hands. At the same time, motion is imparted (see FIG. 6) to the multiple rows of bristles. The hands of the user are brushed with a hand motion of the other hand of the user, and taking advantage of the motion imparted to bristle clusters 18 by the sound wave energy to provide the motion of such bristle clusters as illustrated in FIG. 6, the loosened, moist soil is removed. The same is done with respect to the single row of bristle clusters 32, as enabled by electronic driving module 40, link 46, linkage 36, and piezoelectric transducer 42. Particularly, this single row is used for conducting motion-producing sound waves, loosening the moist soil under the fingernails and the brushing motion of the single row is used to remove such loosened moist soil.

The foregoing provides a complete description of the preferred embodiment of the present invention, but the limits thereof are to be established only by the following claims.

What is claimed is:

1. An ultrasonic hand and fingernail cleaner for operation by a battery, comprising an on-off switch for use with said battery, a non-conductive brush base, first and second sets of longitudinally extending bristle clusters protruding from said brush base, first and second electronic driving modules for operation by said battery, first and second piezoelectric transducers, first and second links coupling said piezoelectric transducers to said sets of bristle clusters and first and second linkages coupling said piezoelectric transducers to said electronic driving modules, and a two-way switch for selective controlling of said coupling of said piezoelectric transducers to said electronic driving modules.

2. A cleaner according to claim 1, whereby said first set of bristle clusters comprises multiple rows of bristle clusters, and said second set of bristle clusters comprises a single row of bristle clusters.

3. A cleaner according to claim 2, wherein said first set of bristle clusters extends in a direction angularly disposed with respect to the direction of extension of said second set of bristle clusters.

4. A cleaner according to claim 1, wherein said brush base comprises a plurality of surfaces, said first set of bristle clusters protruding through one of said surfaces and said second set of bristle clusters protruding through another of said surfaces.

5. A cleaner according to claim 1, wherein said brush base is a solid, generally rectangular shape defining a cavity, said battery, said transducers, said links and said linkages are within said cavity.

* * * * *